US009265982B2

(12) United States Patent
Pickell, III

(10) Patent No.: US 9,265,982 B2
(45) Date of Patent: Feb. 23, 2016

(54) RESISTANCE DEVICE FOR IMPROVING SWING AND STABILIZING LEG POSITION

(71) Applicant: Walter C. Pickell, III, Marietta, GA (US)

(72) Inventor: Walter C. Pickell, III, Marietta, GA (US)

( * ) Notice: Subject to any disclaimer, the term of this patent is extended or adjusted under 35 U.S.C. 154(b) by 189 days.

(21) Appl. No.: 13/683,854

(22) Filed: Nov. 21, 2012

(65) Prior Publication Data

US 2014/0141947 A1 May 22, 2014

(51) Int. Cl.

| | |
|---|---|
| ***A63B 21/00*** | (2006.01) |
| ***A63B 21/04*** | (2006.01) |
| ***A63B 69/18*** | (2006.01) |
| ***A63B 69/36*** | (2006.01) |
| ***A63B 69/00*** | (2006.01) |

(52) U.S. Cl.

CPC ..... *A63B 21/0442* (2013.01); *A63B 21/1423* (2013.01); *A63B 21/1426* (2013.01); *A63B 21/1449* (2013.01); *A63B 21/1484* (2013.01); *A63B 21/151* (2013.01); *A63B 21/4011* (2015.10); *A63B 21/4013* (2015.10); *A63B 21/4025* (2015.10); *A63B 21/4043* (2015.10); *A63B 69/0059* (2013.01); *A63B 69/182* (2013.01); *A63B 69/3608* (2013.01)

(58) Field of Classification Search

USPC ..... 482/121, 124, 55

See application file for complete search history.

(56) References Cited

U.S. PATENT DOCUMENTS

| | | | | |
|---|---|---|---|---|
| 3,372,930 | A | | 3/1968 | Sertich |
| 3,466,040 | A | | 9/1969 | Sertich |
| 4,516,772 | A | | 5/1985 | Stratton |
| 5,188,366 | A | * | 2/1993 | Dorotinsky et al. ..... 473/216 |
| 5,318,290 | A | | 6/1994 | Sawyer |
| 5,344,373 | A | * | 9/1994 | Greene ..... 482/55 |
| 5,470,055 | A | | 11/1995 | Ritchie |
| 5,512,029 | A | * | 4/1996 | Barnard et al. ..... 482/129 |
| 5,613,926 | A | * | 3/1997 | Michaelson ..... 482/121 |
| 5,653,668 | A | * | 8/1997 | Wilkinson ..... 482/124 |
| 5,976,026 | A | | 11/1999 | Erb |
| 6,612,845 | B1 | | 9/2003 | Macri et al. |
| 6,638,176 | B1 | | 10/2003 | Hayes et al. |
| 6,988,966 | B1 | | 1/2006 | Guzman |
| 7,018,301 | B1 | | 3/2006 | Cascerceri et al. |
| 7,335,117 | B2 | | 2/2008 | Reason-Kerkhoff |
| 7,438,653 | B2 | | 10/2008 | Anderson |
| 7,625,320 | B2 | | 12/2009 | Wehrell |
| 7,758,436 | B2 | | 7/2010 | Reynolds |
| 2003/0130072 | A1 | | 7/2003 | Barth et al. |
| 2003/0224882 | A1 | | 12/2003 | Mahoney |
| 2005/0014571 | A1 | | 1/2005 | Varner |
| 2007/0054758 | A1 | | 3/2007 | Cockrell |
| 2010/0125011 | A1 | | 5/2010 | Capps |
| 2010/0222151 | A1 | | 9/2010 | McNamara |
| 2011/0098137 | A1 | | 4/2011 | Golom |
| 2011/0218059 | A1 | | 9/2011 | Leone et al. |

FOREIGN PATENT DOCUMENTS

| | | |
|---|---|---|
| WO | 9401185 | 1/1994 |
| WO | 2004064941 | 8/2004 |

* cited by examiner

*Primary Examiner* — Jerome W Donnelly

(74) *Attorney, Agent, or Firm* — Meunier Carlin & Curfman LLC

(57) ABSTRACT

A resistance device for stabilizing a person's leg position relative to the ground includes an anchor configured for affixing to a stationary object, a first tether segment, a second tether segment, a first fastener configured for securing adjacent an upper portion of a person's leg, and a second fastener configured for securing adjacent a lower portion of the person's leg. The first tether segment extends between the anchor and the first fastener, and the second tether segment extends between the anchor and the second fastener.

20 Claims, 5 Drawing Sheets

RESISTANCE DEVICE FOR IMPROVING SWING AND STABILIZING LEG POSITION

FIELD OF THE DISCLOSURE

The present disclosure relates to resistance devices for stabilizing a person's leg position relative to the ground. According to some embodiments, this device may be used to improve the person's swing or simulate other activities in which the person's leg should remain in a similar position relative to the ground.

BACKGROUND

Proper stabilization and driving force, particularly in the legs, is important to swinging a baseball bat or golf club in sports such as baseball, softball, and golf, and in other sports. In particular it is believed that a swing can be more powerful and efficient by keeping the player's weight on the back foot and hitting off the back foot. Many players have issues with keeping weight on the back foot, particularly younger players. Often, these players will move their feet and legs throughout the swing which affects the player's balance and produces less than desirable results.

Accordingly, there is a need in the art for a resistance device configured for improving the stabilization of a person's leg position during swinging and other activities.

SUMMARY OF THE DISCLOSURE

Disclosed herein are devices and methods for substantially preventing a person from raising a foot from a person's first leg from the ground. In some embodiments, the devices and methods can be used to maintain the weight of the person on a back foot when swinging. In particular, according to various embodiments, a resistance device is provided that includes an anchor configured for affixing to a stationary object, a first fastener configured for securing adjacent an upper portion of a leg of a person, a first tether segment extending between the first fastener and the anchor, a second fastener configured for securing adjacent a lower portion of the leg of the person, and a second tether segment extending between the second fastener and the anchor. According to various embodiments, the stationary object includes the ground, a pole, a door knob, or an eye hook, for example.

In one embodiment, the anchor includes a coiled stake that is configured for screwing into the ground, and in another embodiment, the anchor includes a stake portion that is configured for being pushed into the ground. The anchor, according to these and other embodiments, may be made of metal, plastic, or a combination thereof. In addition, according to some embodiments, the anchor includes a ring, and at least one of the first tether segment and the second tether segment are secured to the anchor through the ring. In certain embodiments, both the first tether segment and the second tether segment are secured to the anchor through the ring, and in a particular embodiment, the first tether segment and the second tether segment are each part of the same tether.

According to other embodiments, the stationary object may be a pole, door knob, or eye hook, and the anchor is a strap, which, according to some embodiments, may be made of fabric, plastic, or combination thereof, and is configured for securing to the stationary object.

According to certain embodiments, the first and second fasteners are straps. In one embodiment, each of the first and second fasteners include a hook fastening field and a loop fastening field for securing each of the first and second fasteners adjacent the leg of the person. According to an alternative embodiment, each of the first fastener and the second fastener includes a buckle for securing each of the first and second fasteners adjacent the leg of the person.

According to some embodiments, the first tether segment terminates in a first loop and the second tether segment terminates in a second loop, and the first fastener and the second fastener are secured to the first tether segment and the second tether segment, respectively, through the first loop and the second loop. In addition, according to various embodiments, the tether is coated with a polymeric material. And, in some embodiments, the first tether segment and the second tether segment are extension straps.

According to some embodiments, the device further includes a sleeve that extends between a portion of the first and second tether segments adjacent the anchor and is configured to restrict a distance through which the portions of the first and second tether segments may be moved relative to each other.

According to one embodiment in which the anchor includes a coiled stake, the step of affixing the anchor to the stationary object includes screwing the coiled stake into the ground. In another embodiment in which the anchor includes a stake portion configured for being pushed into the ground, the step of affixing the anchor to the stationary object includes pushing the stake portion into the ground.

According to various embodiments, a method of substantially preventing a person from raising a foot from a person's first leg from the ground is provided. The method includes: (1) providing at least one resistance device, the at least one resistance device including an anchor, a first fastener, a first tether segment extending between the first fastener and the anchor, a second fastener, and a second tether segment extending between the second fastener and the anchor; (2) affixing the anchor to a stationary object; (3) securing the first fastener adjacent an upper portion of a first leg of the person; and (4) securing the second fastener adjacent a lower portion of the first leg of the person.

In one embodiment, the method can be a method of improving the swing of a person playing a sport, the person when swinging standing such that the first leg is a back leg and the second leg is a front leg, wherein the method comprises securing the first fastener adjacent an upper portion of the back leg of the person and securing the second fastener adjacent a lower portion of the back leg of the person. Typically, if the person is swinging left handed, then the back leg is the left leg of the person, and if the person is swinging right handed, then the back leg is the right leg of the person. The method further includes having the person swing while the first fastener and the second fastener are secured adjacent the back leg.

In one embodiment, such as when simulating skiing, the step of providing at least one resistance device includes providing a first resistance device and a second resistance device. Affixing the anchor to a stationary object can include affixing an anchor from the first resistance device to a stationary object and affixing an anchor from the second resistance device to a stationary object. Securing the first fastener can include securing the first fastener of the first resistance device adjacent the upper portion of the first leg of the person and securing the first fastener of the second resistance device adjacent the upper portion of the second leg of the person. In addition, the method can include securing the second fastener of the first resistance device adjacent the lower portion of the first leg of the person and securing the second fastener of the second resistance device to a lower portion of the second leg of the person.

DETAILED DESCRIPTION

Disclosed herein are devices and methods for substantially preventing a person from raising a foot from a person's first leg from the ground. In some embodiments, the devices and methods are used for maintaining the weight of the person on the person's back foot when swinging.

The described methods, systems, and apparatus should not be construed as limiting in any way. Instead, the present disclosure is directed toward all novel and nonobvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The term "comprising" and variations thereof as used herein is used synonymously with the term "including" and variations thereof and are open, non-limiting terms.

Exemplary Embodiments for Resistance Devices

Figure 1:
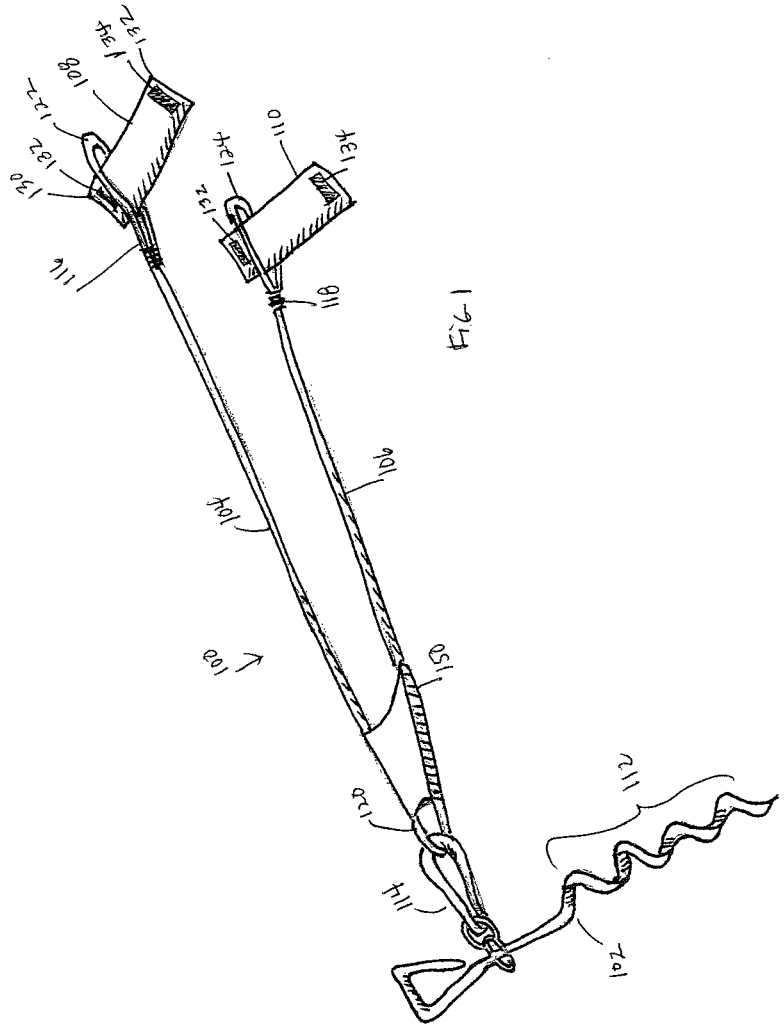
FIG. 1 illustrates a perspective view of a resistance device according to one embodiment.
Figure 2:
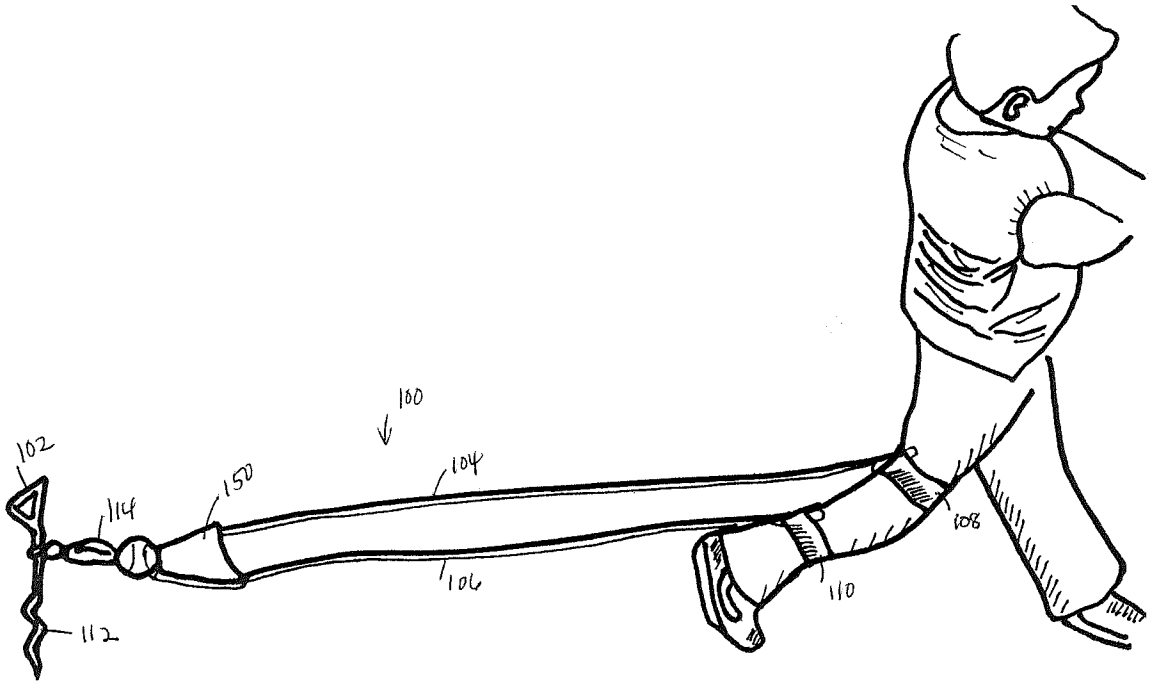
FIG. 2 illustrates a perspective view of the resistance device shown in FIG. 1 secured to a person's back leg.

FIG. 1 is a perspective view of an exemplary embodiment of a resistance device 100. In particular, the resistance device 100 includes an anchor 102, a first tether segment 104, a second tether segment 106, a first fastener 108, and a second fastener 110. The first fastener 108 is configured for securing adjacent an upper portion of a person's leg, and the second fastener 110 is configured for securing adjacent a lower portion of the person's leg, as shown in FIG. 2.

Anchor

The anchor 102 can include a coiled stake portion 112 that is configured for screwing into the ground and a ring 114 disposed above the coiled stake portion 112. The first tether segment 104 and the second tether segment 106 extend between the ring 114 and the first and second fasteners 108, 110, respectively. Although a ring 114 is illustrated in FIG. 1, a closed loop or substantially closed loop can be provided as part of the anchor 102 for attachment of the tether segments 104 and 106.

Figure 4:
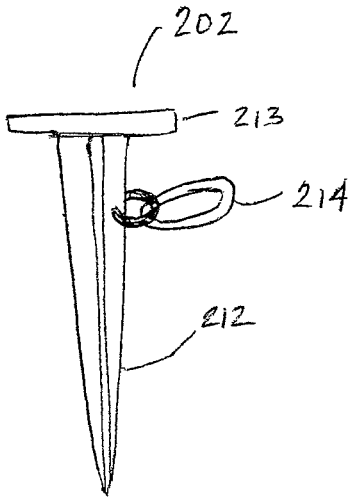
FIG. 4 illustrates an anchor according to an alternative embodiment.
Figure 5:
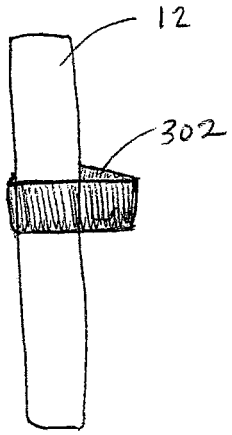
FIG. 5 illustrates an anchor according to another alternative embodiment.

According to an alternative embodiment shown in FIG. 4, the anchor 202 comprises a tapered lower portion 212, a cap portion 213 above the tapered portion 212, and ring 214 below the cap portion 213 to which the first and second tether portions may be secured. The tapered portion 212 can be pushed into the ground by applying force to the cap portion 202 or otherwise. The anchor 102 may be made of metal (e.g., aluminum, steel, zinc, or other suitable metal), fabric, plastic, or a combination of both. According to yet another embodiment, as shown in FIG. 5, the anchor 302 comprises a strap such as a fabric strap or a plastic band that can be secured to a pole 12 (or other stationary object such as a door knob, which is not shown). The strap 302 may be made of fabric, plastic, or a combination of both. In some embodiments, the anchor comprises fabric and plastic.

First and Second Tether Segments

According to the embodiment shown in FIG. 1, the first and second tether segments 104, 106 are part of the same tether cable, and the middle portion 120 of the tether loops through the ring 114 to secure the first and second tether segments 104, 106 relative to the anchor 102. The first tether segment 104 comprises an end 116 that defines a loop 122 through which the first fastener 108 can be thread, and the second tether segment 106 comprises an end 118 that defines a loop 124 through which the second fastener 110 can be thread. According to various embodiments, the tether segments 104, 106 may be a solid or woven material, and at least a portion of the segments 104, 106 may be coated with a polymeric material.

According to various alternative embodiments (not shown), the first and second tether segments are separate cables. In one such embodiment, each of the first and second tether segments have a first end that is secured to the anchor and a second end opposite the first end that is secured to the first and second fasteners, respectively. In another embodiment (not shown), a portion of the first or second tether segment engages the ring 114 of the anchor 102, but the other tether segment does not.

According to various alternative embodiments (not shown), the first and second tether segments can be extension straps.

In some embodiments, the first tether segment and the second tether segment are each part of the same tether. For example, the first tether segment can be a first cable segment and the second tether segment can be a second cable segment, and the first cable segment and second cable segment can be parts of the same cable.

First and Second Fasteners

According to the embodiment shown in FIG. 1, the first and second fasteners 108, 110 are elongated straps, such as fabric or plastic straps, that include a first end 130, a second end 132 opposite the first end 130, a first surface, and a second surface opposite the first surface. In some embodiments, the first end 130 comprises a field of hooks (or loop material) 134 on the first surface of the strap, and the second end 132 comprises a field of loop material (or hooks) 136 on the second surface to receive and engage the field of hooks 134 when the second surface of the strap is secured around the person's leg, as shown in FIG. 2. For example, the first end 130 and second end 132 can be formed of VELCRO®. When the first and second fasteners 108, 110, are secured around the person's leg, the loops 122, 124 of the first and second tether segments 104, 106, respectively, are secured adjacent the person's leg.

Figure 6:
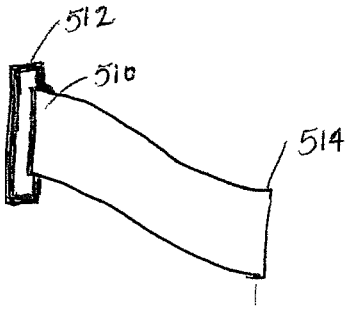
FIG. 6 illustrates a fastener according to an alternative embodiment.

According to other embodiments, such as the embodiment shown in FIG. 6, each of the first and second fasteners comprise a buckle 512 at a first end 510 of the fastener, and a second end 514 of the fastener is configured for looping through the buckle 512 to secure the fastener adjacent the person's leg.

In other embodiments (not shown), the first fastener can be sewn or otherwise fastened to the first tether segment, and the second fastener can be sewn or otherwise fastened to the second tether segment.

Sleeve

In addition, as shown in FIG. 1, the device 100 can further include a sleeve 150 that extends between a portion of the first and second tether segments 104, 106 adjacent the middle portion 120. The sleeve 150 is configured to restrict a distance through which the portions of the first and second tether segments 104, 106 may be moved relative to each other. In the embodiment shown in FIG. 1, the sleeve is a fabric sleeve that substantially wraps around the first and second tether segments 104, 106. According to other embodiments, however, the sleeve may be metal or plastic, or a combination of metal, plastic, and/or fabric.

Exemplary Uses of the Resistance Device

According to various embodiments, a resistance device, such as the resistance device 100 described above in relation to FIG. 1, can be used to improve the swing of a person playing a sport, such as baseball, softball, or golf. When swinging, the person typically stands such that one leg is a front leg and one leg is a back leg. If the person is swinging left handed, then the back leg is the left leg of the person, and if the person is swinging right handed, then the back leg is the right leg of the person.

The coiled portion 112 of the anchor 102 is screwed into the ground to secure the anchor 102 into a stationary position. The first fastener 108 is thread through the end loop 122 of the first tether segment 104 and secured adjacent an upper portion of the person's back leg, and the second fastener 110 is thread through the end loop 124 of the second tether segment 106 and secured adjacent a lower portion of the person's back leg. The person then moves (e.g., walks) in a direction away from the anchor 102 until the first and second tether segments 104, 106 are relatively taut and practice his or her swing. Alternatively, the anchor 102 can be placed at a distance away from the person such that it is taut before being secured in a stationary position. The device 100 prevents the person from raising his or her back leg during the swing motion. In other embodiments, the first fastener 108 may be secured adjacent the lower portion of the person's leg, and the second fastener 110 may be secured adjacent the upper portion of the person's leg.

Figure 3:
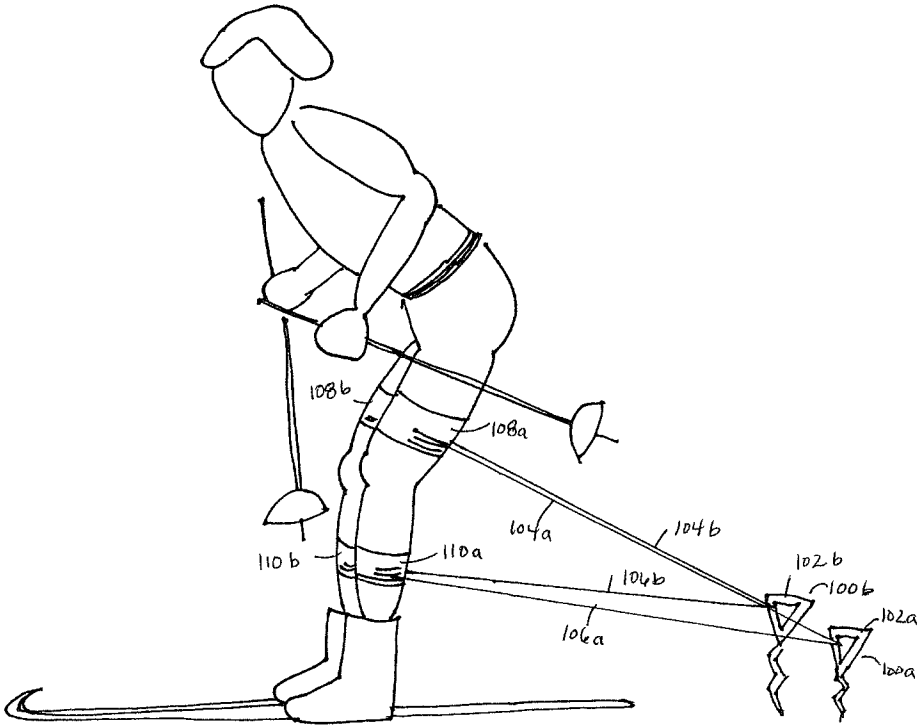
FIG. 3 illustrates a perspective view of two resistance devices, such as the device shown in FIG. 1, secured to each of a person's legs.

The resistance device 100 may also be used to substantially prevent a person from raising at least one of the person's feet from the ground. For example, the resistance device 100 can be used to train a person to swing by maintaining his or her weight on a back foot, such as for sports such as baseball, softball, or golf. Alternatively, at least two resistance devices 100 can be used to train a person to ski by simulating downhill skiing, such as shown in the embodiment shown in FIG. 3. In particular, according to the embodiment shown, two resistance devices 100*a*, 100*b* are provided, and the anchors 102*a*, 102*b*, respectively, are screwed into the ground uphill from the person. The first fasteners 108*a*, 108*b*, respectively, are secured adjacent the upper portion of each leg of the person, and the second fasteners 110*a*, 110*b*, respectively, are secured adjacent the lower portion of each leg of the person. The person can then lean forward in the manner the person would lean downhill to ski with the resistance devices 100*a*, 100*b* holding the person in place on the hill.

What is claimed is:

1. A method of substantially preventing a person from raising a foot from a person's first leg from the ground, the method comprising:

providing at least one resistance device, the resistance device comprising an anchor, a first fastener, a first tether extending between the anchor and the first fastener, a second fastener, and a second tether extending between the anchor and the second fastener;

affixing the anchor to a stationary object;

securing the first fastener adjacent an upper portion of a first leg of the person; and securing the second fastener adjacent a lower portion of the first leg of the person.

2. The method according to claim 1, wherein the person is swinging and the first leg is the back leg of the person.

3. The method according to claim 2, further comprising having the person swing while the first fastener and the second fastener are secured adjacent the first leg.

4. The method according to claim 1, wherein the stationary object is the ground, the anchor comprises a coiled stake, and affixing the anchor to the stationary object comprises screwing the coiled stake into the ground.

5. The method according to claim 4, wherein the anchor comprises a stake portion and affixing the anchor to the stationary object comprises pushing the stake portion into the ground.

6. The method according to claim 1, wherein the anchor includes a ring and at least one of the first tether segment and the second tether segment are secured to the anchor through the ring.

7. The method according to claim 1, wherein the first tether segment and the second tether segment are each part of the same tether.

8. The method according to claim 1, wherein the first tether segment and the second tether segment are extension straps.

9. The method according to claim 1, wherein the first tether segment terminates in a first loop and the second tether segment terminates in a second loop, wherein the first fastener and the second fastener are connected to the first tether segment and the second tether segment, respectively, through the first loop and the second loop.

10. The method according to claim 1, wherein the first fastener and the second fastener each include a hook and loop fastening portion, wherein the first fastener is secured around the upper portion of the back leg using the hook and loop fastening portion of the first fastener, and the second fastener is secured around the lower portion of the back leg using the hook and loop fastening portion of the second fastener.

11. The method according to claim 1, wherein providing at least one resistance device comprises providing a first resistance device and a second resistance device, affixing the anchor to a stationary object comprises affixing an anchor from the first resistance device to a first stationary object and affixing an anchor from the second resistance device to a second stationary object;

securing the first fastener comprises securing the first fastener of the first resistance device adjacent the upper portion of the first leg of the person and securing the first fastener of the second resistance device adjacent the upper portion of the second leg of the person, and securing the second fastener comprises securing the second fastener of the first resistance device adjacent the lower portion of the first leg of the person and securing the second fastener of the second resistance device to a lower portion of the second leg of the person.

12. A resistance device, comprising:

an anchor configured for affixing to a stationary object;

a first fastener configured for securing adjacent an upper portion of a leg of a person;

a first tether segment extending between the first fastener and the anchor;

a second fastener configured for securing adjacent a lower portion of the leg of the person; and a second tether segment extending between the second fastener and the anchor.

13. The device according to claim 12, wherein the first and second fasteners are straps.

14. The device according to claim 12, wherein each of the first and second fasteners comprise a hook fastening field and a loop fastening field for securing each of the first and second fasteners adjacent the leg of the person.

15. The device according to claim 12, wherein the stationary object is the ground and the anchor comprises a coiled stake that is configured for screwing into the ground.

16. The device according to claim 12, wherein the anchor comprises a ring, and at least one of the first tether segment and the second tether segment are secured to the anchor through the ring.

17. The device according to claim 12, wherein the first tether segment and the second tether segment are each part of the same tether.

18. The device according to claim 12, wherein the first tether segment and the second tether segment are extension straps.

19. The device according to claim 12, wherein the first tether segment terminates in a first loop and the second tether segment terminates in a second loop, wherein the first fastener and the second fastener are secured to the first tether segment and the second tether segment, respectively, through the first loop and the second loop.

20. The device according to claim 12, further comprising a sleeve, the sleeve extending between a portion of the first and second tether segments adjacent the anchor and being configured to restrict a distance through which the portions of the first and second tether segments may be moved relative to each other.

* * * * *